US008528995B2

(12) United States Patent
Haltmayer et al.

(10) Patent No.: US 8,528,995 B2
(45) Date of Patent: Sep. 10, 2013

(54) HOUSEHOLD APPLIANCE, PARTICULARLY DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 367 days.

(21) Appl. No.: 12/937,376

(22) PCT Filed: Apr. 7, 2009

(86) PCT No.: PCT/EP2009/054165

§ 371 (c)(1),
(2), (4) Date: Oct. 12, 2010

(87) PCT Pub. No.: WO2009/130130

PCT Pub. Date: Oct. 29, 2009

(65) Prior Publication Data

US 2011/0031856 A1 Feb. 10, 2011

(30) Foreign Application Priority Data

Apr. 25, 2008 (DE) ..... 10 2008 020 883

(51) Int. Cl.
*A47B 77/00* (2006.01)

(52) U.S. Cl.
USPC ..... 312/228

(58) Field of Classification Search
USPC .... 312/257.1, 228, 311, 406, 296; 134/56 D, 134/58 D
See application file for complete search history.

(56) References Cited

U.S. PATENT DOCUMENTS

| | | | | |
|---|---|---|---|---|
| 3,826,553 | A * | 7/1974 | Cushing et al. | 312/351.3 |
| 4,295,692 | A | 10/1981 | Jenkins | |
| 4,359,250 | A * | 11/1982 | Jenkins | 312/228 |
| 6,045,203 | A * | 4/2000 | Marks et al. | 312/228 |
| 2009/0095335 | A1 | 4/2009 | Buehlmeyer et al. | |

FOREIGN PATENT DOCUMENTS

| | | | |
|---|---|---|---|
| CA | 2192269 | A1 | 6/1997 |
| FR | 2685730 | A1 | 7/1993 |
| WO | WO 2007/048697 | * | 5/2007 |

OTHER PUBLICATIONS

International search Report PCT/EP2009/054165.

* cited by examiner

*Primary Examiner* — James O Hansen
(74) *Attorney, Agent, or Firm* — James E. Howard; Andre Pallapies

(57) ABSTRACT

A household appliance including an appliance door and a container to receive goods to be treated. The container has a container opening that is closed by the appliance door. The household appliance further includes stiffeners that are associated, at least in sections, with the container opening. The stiffeners increase the rigidity of the container in a region of the container opening and have a centering element by which the appliance door is aligned with the container opening when the appliance door is closed. The stiffeners and the centering element are made of a uniform material and/or embodied in one piece as a plastic profile part.

24 Claims, 3 Drawing Sheets

Cross-Section I - I

HOUSEHOLD APPLIANCE, PARTICULARLY DISHWASHER

BACKGROUND OF THE INVENTION

The invention relates to a household appliance, particularly a dishwasher.

Household appliances are generally known in which the useable space is closed off by an appliance door. In its closed position, the appliance door can be arranged on both sides between frame parts of the household appliance.

In such a closed position the correctly-positioned arrangement of the appliance door is of importance in order to retain an even gap dimension between the appliance door and the frame parts. An even gap dimension guarantees inter alia that the inner side of the appliance door is reliably in sealing contact with a seal enclosing the loading opening of the useable space.

Maintenance of the gap dimension is especially difficult with dishwashers, of which the washing container opening is surrounded by a plastic frame. The plastic frame has a reduced rigidity compared to a steel frame. Thus a tilting of the dishwasher can result in a deformation of the plastic frame, whereby sufficient coverage of the inner side of the appliance door by the sealing element provided on the plastic frame is no longer guaranteed. To bring about a correction of the alignment of the appliance door to the washing container opening essentially mushroom-shaped introduction aids are inserted into holes. However this increases the assembly effort involved.

BRIEF SUMMARY OF THE INVENTION

The object of the invention is to provide a domestic appliance in which the appliance door, in its closed position, with reduced assembly effort, is in reliable sealing contact with a sealing element.

The invention is based on a household appliance, especially a dishwasher, at least featuring a container for receiving goods, especially dishes, to be treated, having a container opening able to be sealed with a appliance door, at least sections of which are assigned stiffening means to increase the rigidity of the container in the area of the container opening, having at least one centering element through which, when the appliance door is closed, an alignment of the appliance door to the container opening is able to be effected.

In accordance with an exemplary embodiment of the invention, the reinforcement means and the at least one centering element are embodied in a uniform material and/or in one piece as a plastic profile section, especially in a plastic injection-molding process. When moved into its closed position the appliance door is thus centered in the correct position by means of the centering element, which guarantees a sufficient coverage between the appliance door and the sealing element.

Preferably there is provision, in the closed position of the appliance door, for there to be stiffening means arranged between at least two opposite sections of the container opening. This two-sided arrangement ensures especially reliably that the appliance door is aligned in relation to the opening such that an optimum sealing effect is provided.

Further there is preferably provision for the stiffening means to be embodied as frame parts at least partly surrounding the container opening. For example the frame parts can be arranged as a U shape on three sides of an essentially rectangular container opening and thus at the same time bring about a mechanical stiffening of the container in the area of the container opening.

There is also preferably provision for the at least one centering element to define a gap dimension (a) between the appliance door and the stiffening means. A reliable function of the seal and also a problem-free actuation of the appliance door are thus guaranteed.

In its closed position, the appliance door can be submerged between delimiting sides of the device-side frame parts facing towards each other until it makes sealing contact with the sealing element. The inventive centering ensures a trouble-free sealing contact between the inside of the door and the sealing element.

Especially in the case of a dishwasher the frame parts can form part of a loading opening of a frame enclosing the washing container, especially a plastic frame.

In the event of it being formed as an integral part onto the frame part, the centering element can be a bulge projecting from the frame part. The bulge can preferably not only be rotation-symmetrical but can also be elongated in the form of a strip in the depth direction of the household appliance. This guarantees a reliable guidance of the sides of the appliance door between the two frame parts during a closing movement.

The sealing element surrounding the front-side useable space opening can be held in a sealing groove. This groove in its turn can be molded onto the frame parts as an integral component. The sealing groove can be designed to be open at the front.

When the plastic frame with integrated centering element is manufactured, its geometry is to be designed so that no undercuts on the plastic frame prevent a demolding movement of the injection molding tools. Against this background it is preferred that the centering element formed onto the delimiting side of the plastic frame extends directly to a section protruding from the delimiting side. In this way no undercut is formed between the centering element and the protruding section. The section protruding from the delimiting side can be a step for example on which the sealing element sits.

BRIEF DESCRIPTION OF THE DRAWINGS

An exemplary embodiment of the invention is described below with reference to the enclosed figures.

The figures show.

DETAILED DESCRIPTION OF EXEMPLARY EMBODIMENTS OF THE PRESENT INVENTION

Figure 1:
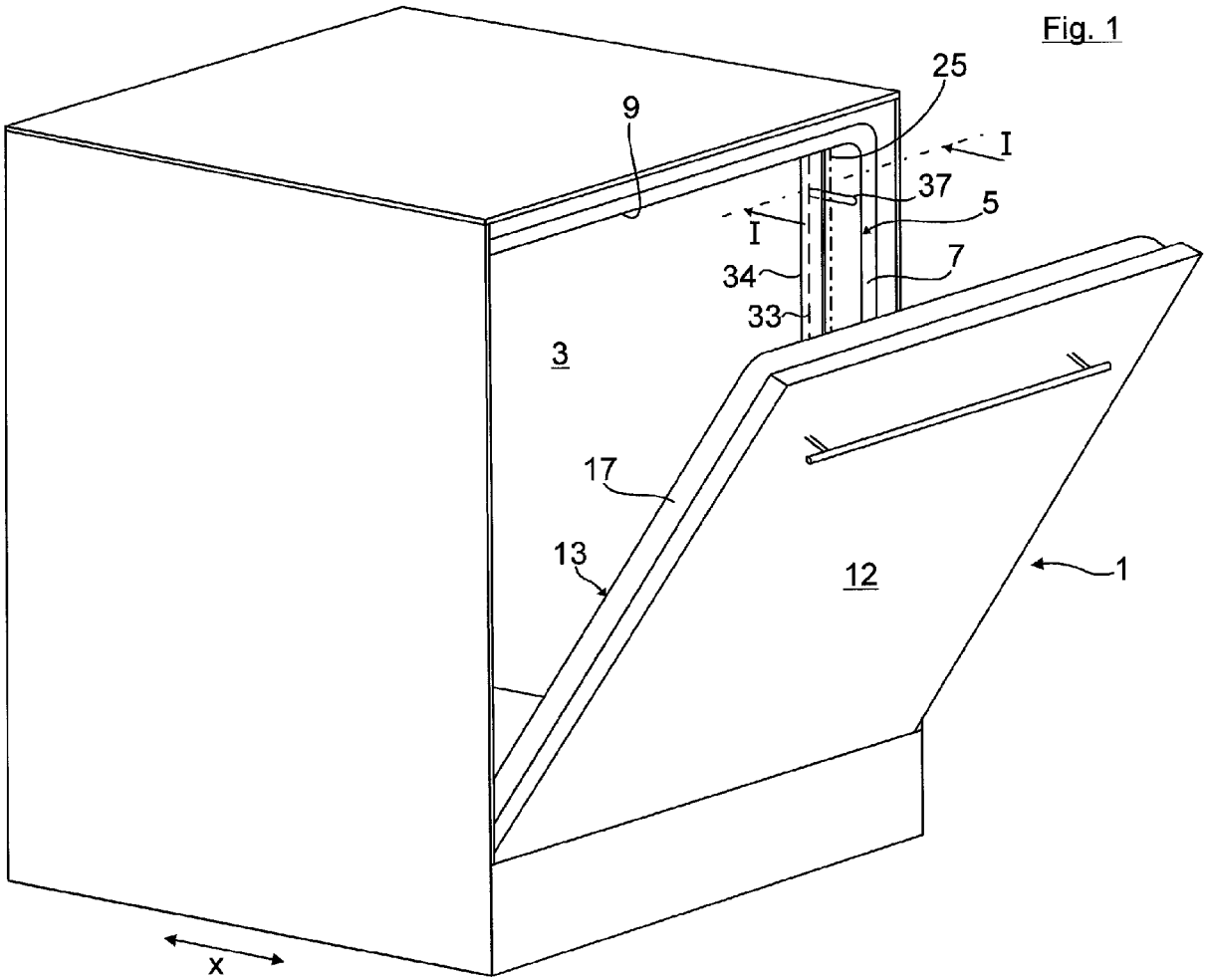
FIG. 1 in a perspective view as a household appliance, a dishwasher with its door half open.

FIG. 1 shows a perspective view of a dishwasher as a household appliance, the front door 1 of which is shown half open. The dishwasher has as its useable space a washing container 3 made of stainless steel plate.

The washing container 3 is connected at its front loading opening to a plastic frame 5. This encloses the front loading opening and features two lateral vertical frame parts 7 which are connected by a horizontal upper frame part 9.

Figure 2:
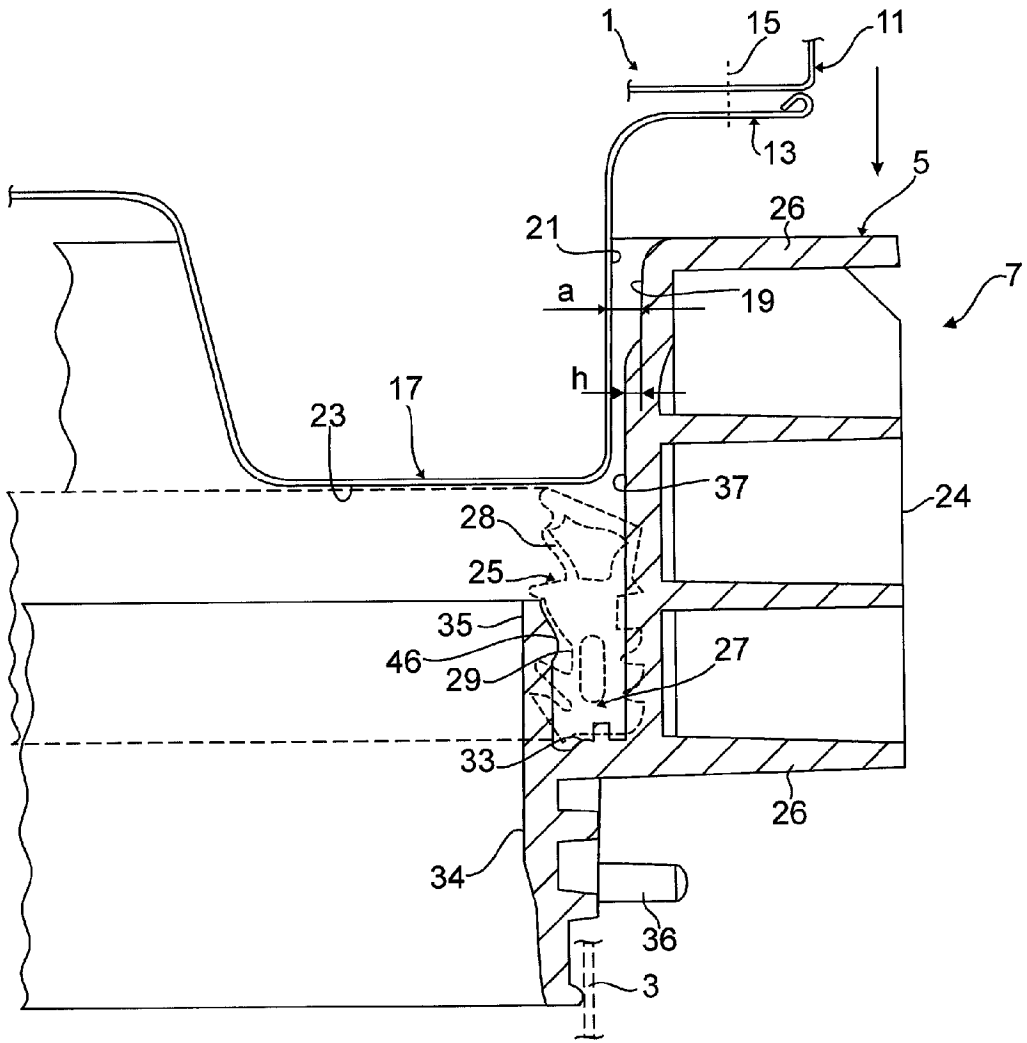
FIG. 2 a part sectional diagram along cut line I-I shown in FIG. 1.

The appliance door 1 of the dishwasher is formed in the known way from a front outer section 11, on which a decor panel 12 may be provided, and an inner door section 13 made of deep-drawn metal which in accordance with FIG. 2 is connected by screws 15. The inner part 13 of the appliance door 1 has at least partly surrounding, deep-drawn side pillars 17 at its edges. In a closed position of the appliance door 1 the side pillars 17 of the door inner section 13 are submerged between delimiting sides 19 of the frame parts 7, 9 of the plastic frame 5 facing towards each other.

The outer edge sides 21 of the side pillars 17, in the closed position of the appliance door 1, re spaced away from the delimiting sides 19 of the frame parts 7, 9 by a gap dimension a, as is indicated in FIG. 2. In FIG. 2 the appliance door 1 is shown in an enlarged sectional view with the side pillar 17 submerged around halfway into the plastic frame 5.

When the appliance door 1 is completely submerged between the frame parts 7, 9 the side pillars 17 of the inner part of the door 13 rest with their front sides 23 in sealing contact with a sealing element 25 which is provided on the delimiting side 19 of the plastic frame part 5 and surrounds the loading opening of the washing container 3. In FIG. 1 the sealing element 25 is merely indicated as a dotted and dashed line.

The plastic frame 5 in accordance with FIG. 2, has a basic body 24 embodied in cross-section as a U-shaped profile, in the hollow space of which open to the outside stiffening ribs run in parallel to the two opposite U arms 26 of the basic body 24. At its end facing away from the front inside the basic body 24 is extended via a step 33 towards the inside with a connecting flange 34 into the usable space of the washing container 3. This is overlapped in the depth direction x by the stainless steel plate of the washing container 3 and connected by means of molded-on connecting bolts 36 to the washing container 3.

The connecting flange 34 is offset inwards by the step 33 in relation to the basic body 24 of the plastic frame 5. In addition the connecting flange 34 is extended by a wall section 35 to the front side of the appliance which is in parallel to the delimiting side 19 of the plastic frame 5. Between the wall section 35 and the delimiting side 19 of the plastic frame 5 a sealing groove 27 is formed which extends along the frame parts 7, 9 and is open on its front side.

The sealing element 25 is inserted into the sealing groove 27 open to the front molded on the plastic frame 5. The sealing element 25 is shown undeformed by a dashed line in FIG. 2. Accordingly the sealing element 25 has an upper sealing section 28 which is roughly tube shaped, which protrudes from the sealing groove 27 as well as adjoining this a sealing shaft 29 inserted into the sealing groove 27. The sealing groove 27 is molded with its groove base, which is formed by the step 33, directly onto the delimiting sides 19 of the plastic frame 5.

In the two opposite upper corner areas of the plastic frame a centering element 37 is provided in each case on the delimiting side 19 of the lateral frame parts 7, of which only one element is shown in FIG. 1. The centering element 37 is integral with the frame part 7 and is embodied as a bulge projecting by a height h inwards from the delimiting side 19. The centering element 37 is embodied in accordance with the figures in the shape of a strip in a depth direction x and extends into the sealing groove 27, whereby good lateral guidance of the appliance door 1 is guaranteed during a closing movement.

As emerges especially from FIG. 2, the strip-shaped bulge 37 in this case merges directly into the groove base 33 of the sealing groove 27. Such a geometry of the centering element 37 is especially advantageous for producing the plastic frame 5 in an injection molding process, which is illustrated with reference to FIG. 3.

Figure 3:
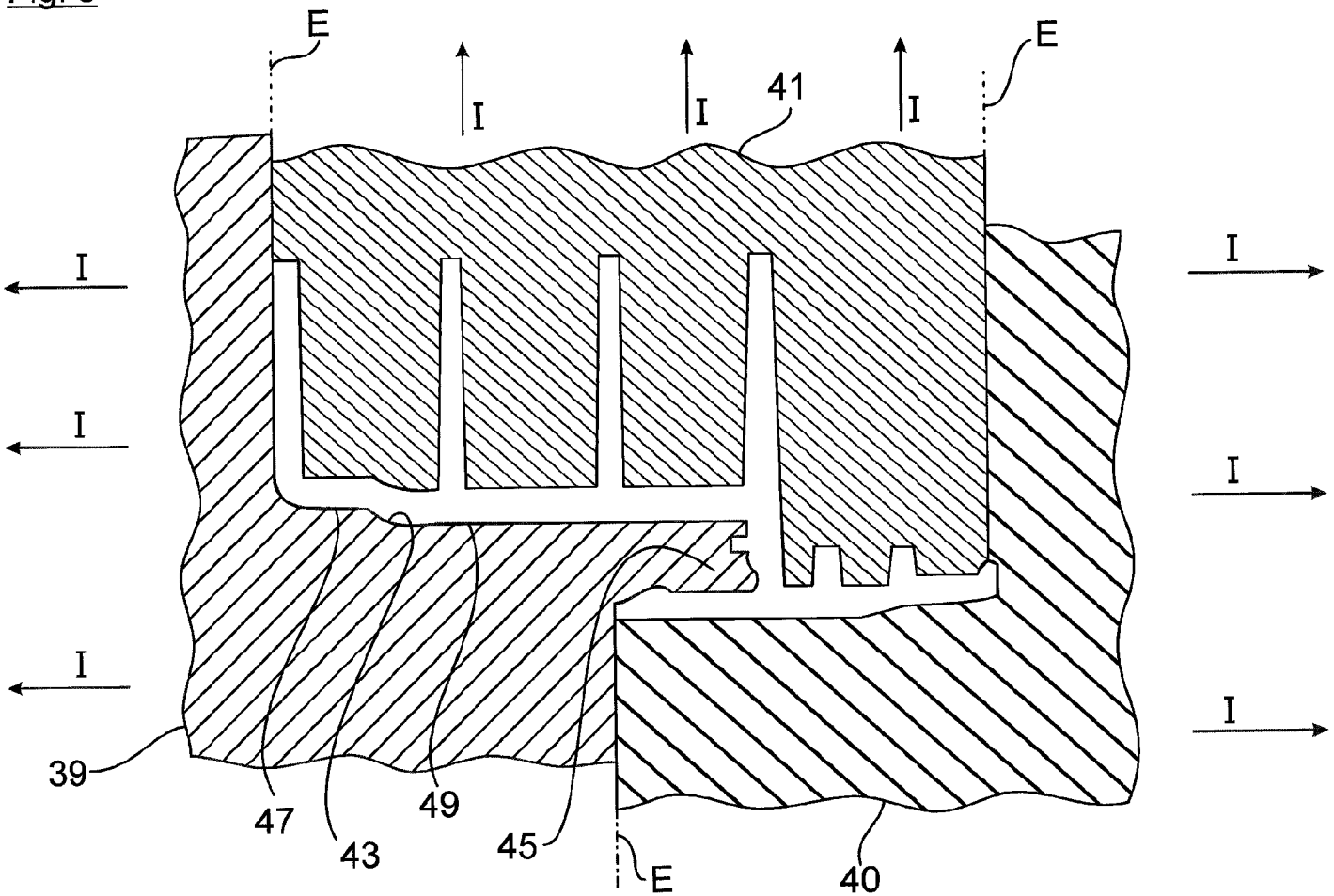
FIG. 3 in a cross-sectional view of plastic injection-molding tools which delimit an injection-molding chamber for forming a plastic frame.

FIG. 3 shows the injection molding tools 39, 40, 41 together delimit an injection molding chamber 43, with which the plastic frame 5 with integrated centering element 37 will be formed.

The injection molding tool 39 is of importance in conjunction with the inventive centering element 37 integrated into the plastic frame 5. The injection molding tool 39 adjoins the further injection molding tools 40, 41 via demolding planes E and has a protrusion 45 with which the sealing groove 27 for the sealing element 25 is formed.

The injection molding tool 39 has a substantially flat molding surface 47 with which the delimiting sides 19 of the plastic frame 5 facing inwards are formed. Provided in the molding surface 47 is a channel-shaped indentation 49 which forms the centering element 37. The indentation 49 runs at a constant depth which is identical to the height h of the centering element 37 up to the end face side of the mold projection 45. With the geometry of the centering element 37 on the plastic frame 5 shown no additional undercuts between the centering elements 37 and the groove base 33 are thus produced, which would make the injection molding method more difficult.

After molding of the plastic frame 5 is completed the injection molding tool 39 can thus be pushed in the demolding direction I out of the sealing groove 27, without undercuts on the delimiting side 19 of the plastic frame 5 having to be overcome.

Accordingly, after successful molding, the other two injection molding tools 40, 41 can also be moved apart in the demolding direction I.

As further emerges from FIG. 2 and FIG. 3, a holder section 46 projecting into the sealing groove 27 is provided on the wall section 35. The holder section 46 secures the sealing element 25 inserted into the sealing groove 27 and is provided on the free, front-side end of the wall section 35. Thus an undercut is formed by the holder section 46.

The wall section 35 is however molded sufficiently elastically flexible on the plastic frame 5. With a demolding movement of the injection molding tool 39 the wall section 35 with its undercut can thus deflect elastically. This means that the demolding process is easily possible.

By contrast with the elastically flexible wall section 35, the rigidly embodied basic body 24 of the plastic frame with its delimiting side 19 cannot yield elastically, so that on the rigid basic body 24 undercuts on the delimiting side are to be avoided.

In the event of the dishwasher being in a tilted position the plastic frame 5 can become distorted. In order to still guarantee in this case an operationally-secure sealing contact between the door inner section 13 and the sealing element 25, during a closing movement of the appliance door 1, there is automatic centering in the closed position of the appliance door 1 within the plastic frame 5.

This guarantees an even gap dimension a between the inner section 13 of the appliance door 1 and the delimiting sides 19 of the plastic frame 5. The positionally-correct arrangement of the appliance door 1 in the closed position also guarantees the functional safety of the door lock.

LIST OF REFERENCE SIGNS

1 Appliance door
3 Washing container
5 Plastic frame
7 Lateral frame parts
9 horizontal frame part
11 Front outer door section

13 Inner door section
15 Screw connection
17 Side uprights
19 Delimiting sides
21 Outer edge sides
23 Front side
24 Basic body of the plastic frame 5
25 Sealing element
26 U-arms of the plastic frame
27 Sealing groove
28 Sealing section
29 Sealing shaft
33 Step
34 Connecting flange
35 Wall section
36 Connecting bolts
37 Centering element
39, 40, 41 Injection molding tools
43 Injection molding chamber
45 Projection
46 Holder section
47 Forming surface
49 Channel-shaped indentation
a; Gap dimension
b; Height
x Depth direction
E Demolding plane
I Demolding direction

The invention claimed is:

1. A household appliance, comprising:

an appliance door;

a container to receive goods to be treated, the container having a container opening that is closed by the appliance door; and a plurality of stiffeners associated, at least in sections, with the container opening, the plurality of stiffeners to increase the rigidity of the container in a region of the container opening, said plurality of stiffeners defining at least one delimiting side facing the interior of the container and proximal to the appliance door when the appliance door is in a closed position, and the plurality of stiffeners having a centering element by which the appliance door is aligned with the container opening when the appliance door is closed;

wherein the plurality of stiffeners and the centering element are made of a uniform material and/or comprise a one piece plastic profile part, and wherein, when the appliance door is in the closed position, a gap dimension between the appliance door and the at least one delimiting side of the plurality of stiffeners is greater than a gap dimension between the appliance door and the centering element.

2. The household appliance of claim 1, wherein the household appliance is a dishwasher; wherein the goods to be treated are dishes; and wherein if the plurality of stiffeners and the centering element comprise a one piece plastic profile part the plastic profile part comprises an injection molded part.

3. The household appliance of claim 1, wherein, in the closed position of the appliance door, the appliance door is located between two of the plurality of stiffeners that are arranged on opposite sections of the container opening.

4. The household appliance of claim 3, wherein the plurality of stiffeners are embodied as frame parts that at least partly surround the container opening.

5. The household appliance of claim 4, further comprising a sealing element, wherein, in the closed position of the appliance door, the appliance door is submerged between the at least one delimiting side of the frame parts that are assigned to each other until the appliance door makes a sealing contact with the sealing element.

6. The household appliance of claim 5, wherein a respective at least one delimiting side of each of the frame parts extends up to a step on which the sealing element sits.

7. The household appliance of claim 4, wherein the centering element is a protrusion projecting from a respective one of the frame parts.

8. The household appliance of claim 7, wherein the protrusion is elongated in a depth direction of the household appliance.

9. The household appliance of claim 4, wherein the centering element extends up to a section projecting from at least one respective delimiting side of a respective one of the frame parts.

10. The household appliance of claim 9, wherein the section is a step.

11. The household appliance of claim 1, wherein the centering element is elongated in a depth direction in the form of a strip.

12. The household appliance of claim 1, wherein each of the plurality of stiffeners has a rigid basic body, which encloses a loading opening, and a connecting flange which is connected to the container.

13. The household appliance of claim 12, wherein the centering element is arranged on the rigid basic body.

14. A household appliance to treat goods, the household appliance comprising:

a container to receive the goods to be treated, said container having a container opening and defining an interior region;

an appliance door to seal the container opening;

at least one frame part attached to the container and having a plurality of stiffeners, said at least one frame part defining a delimiting side adjacent to the appliance door when the appliance door is in a closed position, said delimiting side facing the interior region of the container;

a gap between the at least one frame part and the appliance door when the appliance door is in the closed position, said gap having a gap dimension; and a centering element comprising a protrusion configured to align the appliance door with the container opening as the appliance door is moved into the closed position, wherein the gap dimension is smallest at a point where the protrusion is positioned.

15. The household appliance of claim 14, wherein the at least one frame part and the centering element are made of a uniform material and/or comprise a one piece plastic profile part.

16. The household appliance of claim 15, wherein the household appliance is a dishwasher, wherein the goods to be treated are dishes, and wherein if the at least one frame part and the centering element comprise a one piece plastic profile part the plastic profile part comprises an injection molded part.

17. The household appliance of claim 14, further comprising:

two of the at least one frame part, wherein when the appliance door is in the closed position the appliance door is located between two of the at least one frame part, each of said two of the at least one frame part arranged on opposite sides of the container opening.

18. The household appliance of claim 17, further comprising:

a wall section projecting from each of the at least one frame part toward the interior region of the container, said wall section and each of said at least one frame part defining a sealing groove; and a sealing element located in the sealing groove, wherein when the appliance door is in the closed position said sealing element being in sealing contact with the appliance door.

19. The household appliance of claim 18, wherein the wall section is set off from the frame part by a step.

20. The household appliance of claim 18, wherein the sealing element is releasably retained within the sealing groove by a compression fit.

21. The household appliance of claim 20, wherein the wall section further comprises a holder projecting from the wall section toward the delimiting side and the centering element, said holder configured to releasably retain the sealing element within the sealing groove.

22. The household appliance of claim 14, wherein the centering element is elongated in a depth direction of the container.

23. The household appliance of claim 14, wherein the centering element is tapered such that the gap dimension between the appliance door and the centering element decreases in a depth direction into the interior region of the container.

24. The household appliance of claim 14, wherein the centering element projects into the gap from the delimiting side of the at least one frame part.

* * * * *